US005160147A

United States Patent [19]

Ping

[11] Patent Number: 5,160,147

[45] Date of Patent: Nov. 3, 1992

[54] TOY BALL GAME SET

[76] Inventor: Chen C. Ping, No. 101, Shi Chou Road, Yi Shin Village, Taiping Hsiang, Taichung Hsien, Taiwan

[21] Appl. No.: 833,495

[22] Filed: Feb. 10, 1992

[51] Int. Cl.[5] ..... A63B 67/00

[52] U.S. Cl. ..... 273/346; 273/67 R; 273/DIG. 30

[58] Field of Search ..... 273/346, 67 R, DIG. 30, 273/344, 345, 347

[56] References Cited

U.S. PATENT DOCUMENTS

| | | | |
|---|---|---|---|
| 4,131,278 | 12/1978 | Goldenberg | 273/67 R |
| 4,148,483 | 4/1979 | Sweet et al. | 273/67 R |
| 4,735,420 | 4/1988 | Seidler | 273/346 X |
| 5,080,374 | 1/1992 | Yu | 273/346 |

*Primary Examiner*—William H. Grieb

*Attorney, Agent, or Firm*—Morton J. Rosenberg; David I. Klein

[57] ABSTRACT

A ball game set comprised of a racket, and a ball covered with a layer of fastening fabrics, the racket being comprised of a ring-shaped frame covered with a membrane at one side and a layer of fastening fabrics at an opposite side, the ring-shaped frame being to define with the membrane and the layer of fastening fabrics a sound chamber, wherein striking the membrane against the ball causes the ball to be bounded from the racket, and simultaneously causes the sound chamber to produce a sound; striking the layer of fastening fabrics against the ball causes the ball to be caught by the racket.

4 Claims, 2 Drawing Sheets

TOY BALL GAME SET

BACKGROUND OF THE INVENTION

The present invention relates to a toy ball game set. More particularly, the present invention relates to such a toy ball may set which is comprised of at least one racket and a ball, wherein hitting the ball by the racket causes the ball to be bounded from the racket, and simultaneously causes the racket to produce as sound like beating a drum.

Several toy bal game sets have been known for children to play. In the game of toy tennis, badminton or baseball, a toy racket or toy baseball bat is used in hitting a ball causing it to bound. Further, in playing a toy baseball game, a mitt ay be used in catching a ball. While playing the game of toy tennis or badminton, it is difficult for children to catch a ball by a racket. The present invention has been accomplished to provide a special design of toy ball game set which permits a child to catch a ball by a racket easily. Further, a racket according to the present invention will produce a sound upon each strike against a ball.

SUMMARY OF THE INVENTION

According to the present invention, there is provided a bal game set which is generally comprised of a racket, and a ball covered with a layer of fastening fabrics, said racket being comprised of a ring-shaped frame covered with a membrane at one side and a layer of fastening fabrics at an opposite side, said ring-shaped frame being to define with said membrane and said layer of fastening fabrics a sound chamber, wherein striking said membrane against said ball causes said ball to be bounded from said racket, and simultaneously causes said sound chamber to produce a sound; striking said layer of fastening fabrics against said ball causes said ball to be caught by said racket.

DETAILED DESCRIPTION OF THE PREFERRED EMBODIMENT

Referring to the annexed drawings in detail, a ball game set according to the present invention is generally comprises of at least one racket and a ball.

Figure 1:
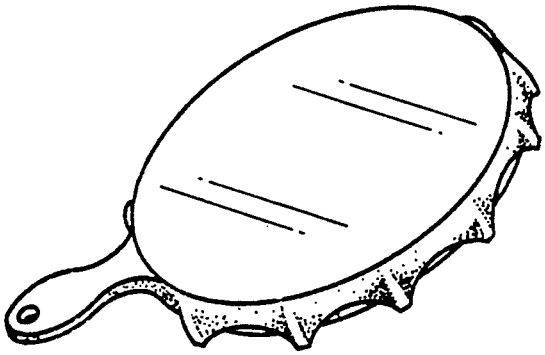
FIG. 1 is an elevational view of a racket according to the present invention.
Figure 2:
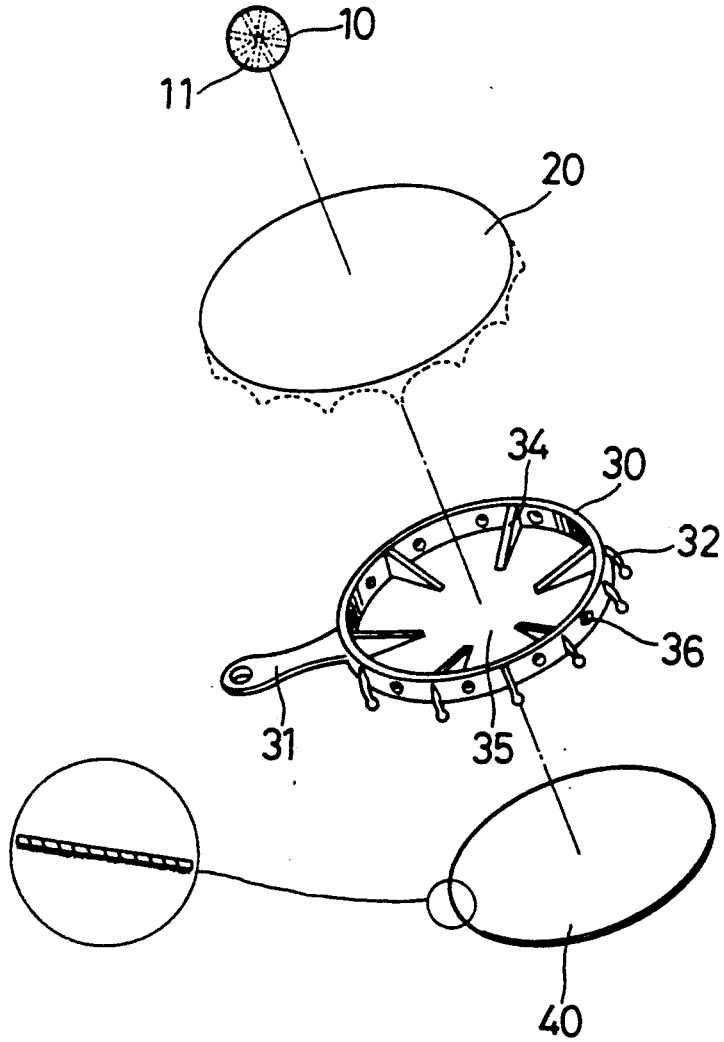
FIG. 2 is an exploded view of the preferred embodiment of the present invention.

As illustrated in FIG. 2, a ball 10 which provides good power of bouncing is entirely covered with a layer of male (female) fastening fabrics 11. VELCRO material may be used for the layer of fastening fabrics. A racket 30 is comprised of a substantially ring-shaped frame 36 having hooks 32 around the outer wall surface thereof and reinforce ribs 34 around the inner wall surface thereof, a membrane 20 stretched over said ring-shaped frame 36 at one side, a layer of female (male) fastening fabrics 40 covered over said ring-shaped frame 36 at an opposite side, and a handle 31 transversely extending outwards from said ring-shaped frame 36 for holding by the hand. By hanging the peripheral edge of the membrane 20 from the hooks 32, the membrane 20 is firmly stretched over the ring-shaped frame 36 at one side, forming into a striking surface 33 (see FIG. 3) for hitting the bal 10. The membrane 20 is made from a resilient material, for example, rubber, leather or any suitable material which produces satisfactory power of bouncing. Further, the ring-shaped frame 36 defines therein a space which when covered by the membrane 20 and the layer of female (male) fastening fabrics 40 forms into a sound chamber for producing a sound upon striking of the racket 20 against the ball 10.

Figure 4:
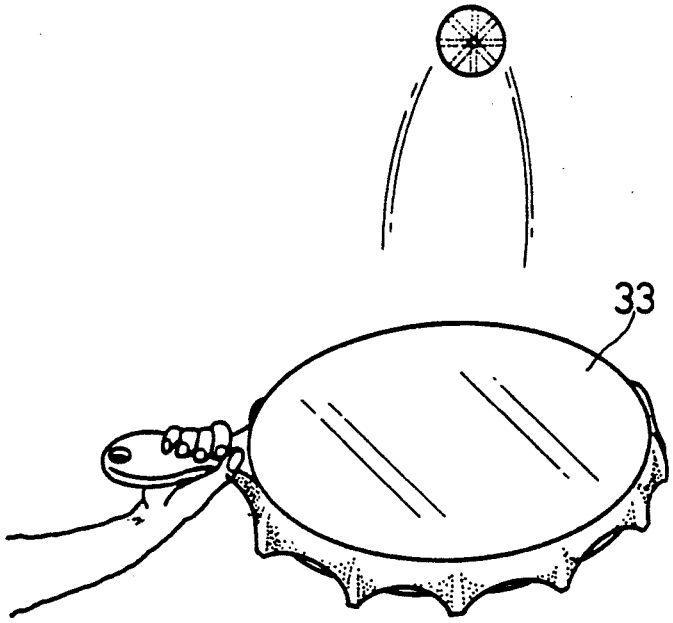
FIG. 4 illustrates another application of the present invention for one person to play.
Figure 3:
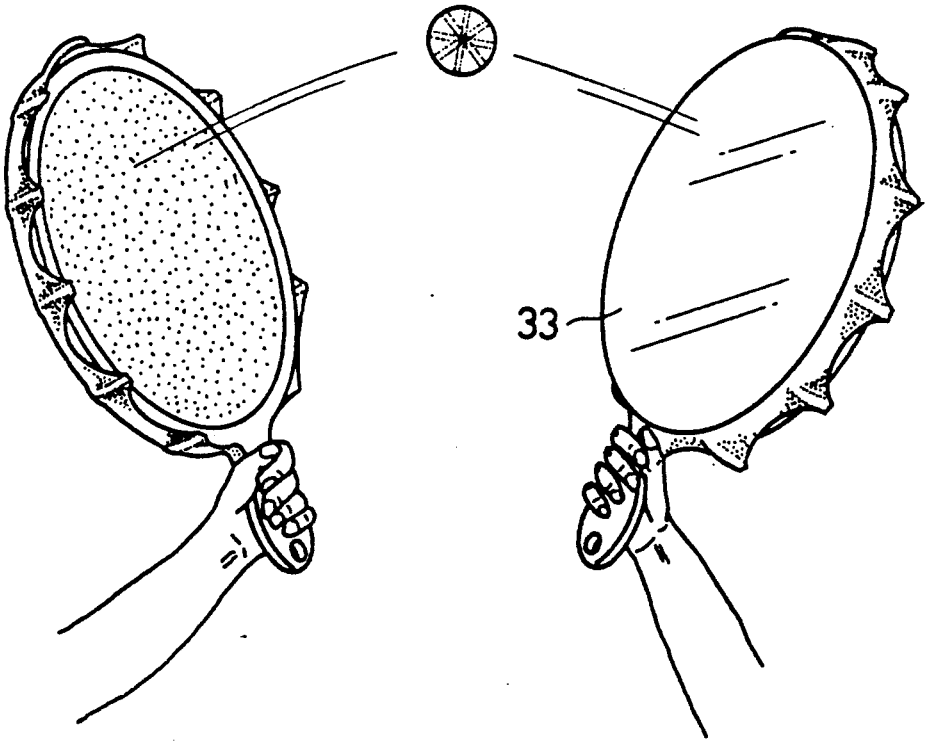
FIG. 3 illustrates an application of the present invention for two people to play.

Referring to FIGS. 3 and 4, the present invention can be used for one or two people to play. Hitting the striking surface 33 of the membrane 20 against the ball 10 causes the ball 10 to be bounded from the racket 32, and at the same time, causes the sound chamber 35 to produce a sound. Further, the layer of female (male) fastening fabrics 40 can be used in catching the ball 10. When the bal 10 hits the layer of female (male) fastening fabrics 40, its outer covering layer of male (female) fastening fabrics 11 becomes firmly secured to the layer of female (male) fastening fabrics 40, and therefore, the ball 10 is firmly caught by the racket 36. Further, when the membrane 20 is uncovered, the racket 36 can be used as a toy tools in catching and holding sands.

What is claimed is:

1. A ball game set comprising a racket, and a ball covered with a layer of fastening fabrics, wherein said racket is comprised of a hollow frame having hooks around an outer wall surface thereof and reinforcing ribs around an inner wall surface thereof, a membrane stretched over adds ring-shaped frame at one side an peripherally secured to said hooks, a layer of fastening fabrics covered over said ring-shaped frame at an opposite side, and a handle transversely extending outwards from said ring-shaped frame for holding of the hand, said hollow frame being to define with said membrane and said layer of fastening fabrics a sound chamber.

2. The ball game set according to claim 1, wherein striking said membrane against said ball causes said bal to be bounded from said racket, and simultaneously causes said sound chamber to produce a sound; striking said layer of fastening fabrics against said ball causes said ball to be caught by said racket.

3. The ball game set according to claim 1, wherein said hollow frame is made in the shape of a ring.

4. The ball game set according to claim 1, wherein said membrane is made from a material that provides a power of bouncing.

* * * * *